US007069868B2

(12) United States Patent
Cerliani

(10) Patent No.: US 7,069,868 B2
(45) Date of Patent: Jul. 4, 2006

(54) CENTRAL BOBBIN SHUTTLE

(76) Inventor: Daniele Cerliani, Piazza Dante 4 - 27100, Pavia (IT)

( * ) Notice: Subject to any disclaimer, the term of this patent is extended or adjusted under 35 U.S.C. 154(b) by 241 days.

(21) Appl. No.: 10/683,515

(22) Filed: Oct. 9, 2003

(65) Prior Publication Data

US 2004/0084102 A1 May 6, 2004

(30) Foreign Application Priority Data

Oct. 22, 2002 (IT) ..... MI2002A2243

(51) Int. Cl.
*D05B 57/12* (2006.01)

(52) U.S. Cl. ..... 112/185

(58) Field of Classification Search ..... 112/185, 112/192, 189, 190, 196, 231, 232, 220, 228, 112/181

See application file for complete search history.

(56) References Cited

U.S. PATENT DOCUMENTS

| | | | | |
|---|---|---|---|---|
| 856,830 | A * | 6/1907 | Zanzig | 112/196 |
| 1,877,757 | A * | 9/1932 | Hemleb | 112/192 |
| 3,082,722 | A * | 3/1963 | Tateishi | 112/181 |
| 4,643,112 | A * | 2/1987 | Sidler et al. | 112/185 |
| 5,029,544 | A * | 7/1991 | Shimizu | 112/192 |

* cited by examiner

*Primary Examiner*—Ismael Izaguirre
(74) *Attorney, Agent, or Firm*—Sheridan Ross P.C.

(57) ABSTRACT

A shuttle unit of the type comprising a discoid shuttle body provided with two conical portions, one front and one rear, disposed specularly with respect to the median plane of said shuttle body passing through the race of the shuttle body, and a shuttle driver guided in rotation to make the shuttle body oscillate. The front and rear portions define a containing cavity for the bobbin case and the thread bobbin. The front conical portion forms a base angle with the median plane of the shuttle body comprised between 43° and 49°.

23 Claims, 4 Drawing Sheets

FIG. 4
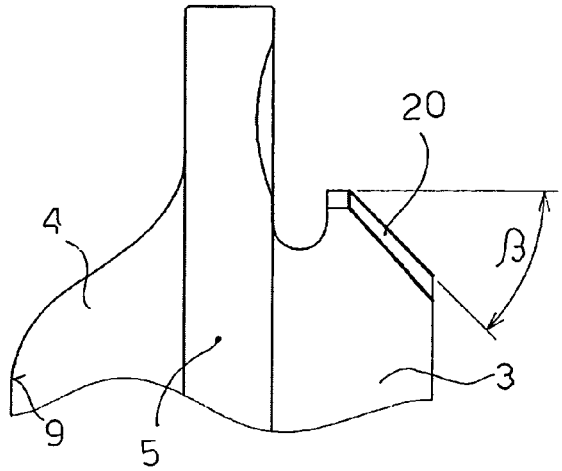
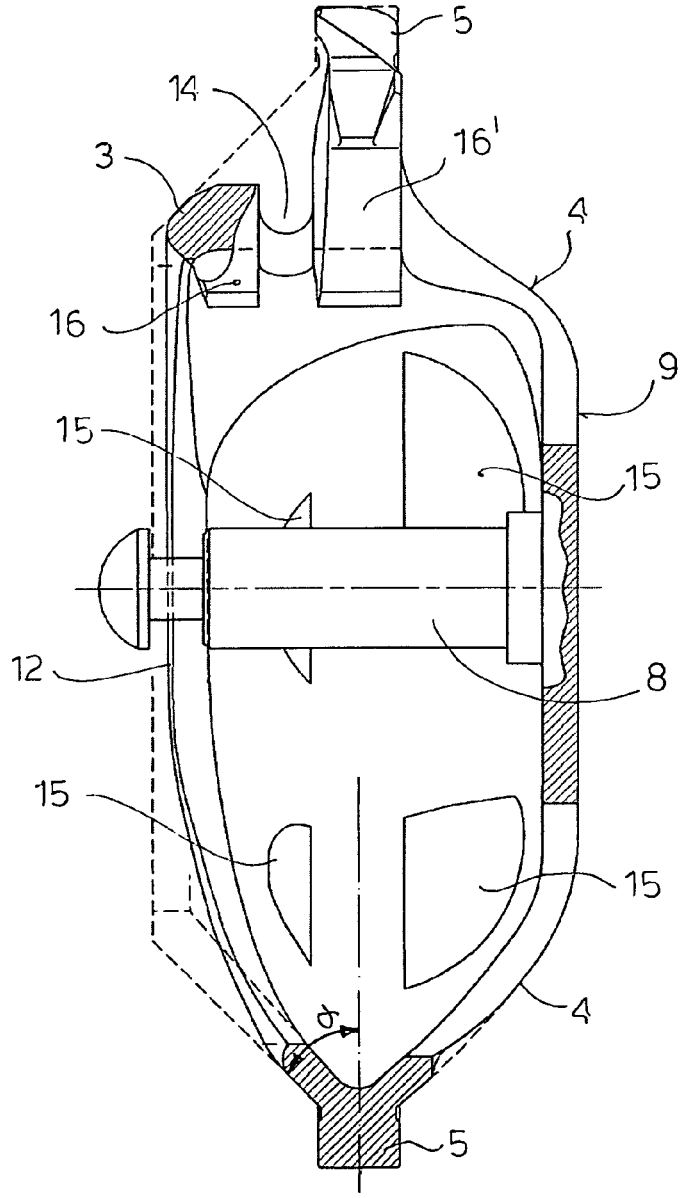
FIG. 5

FIG 6
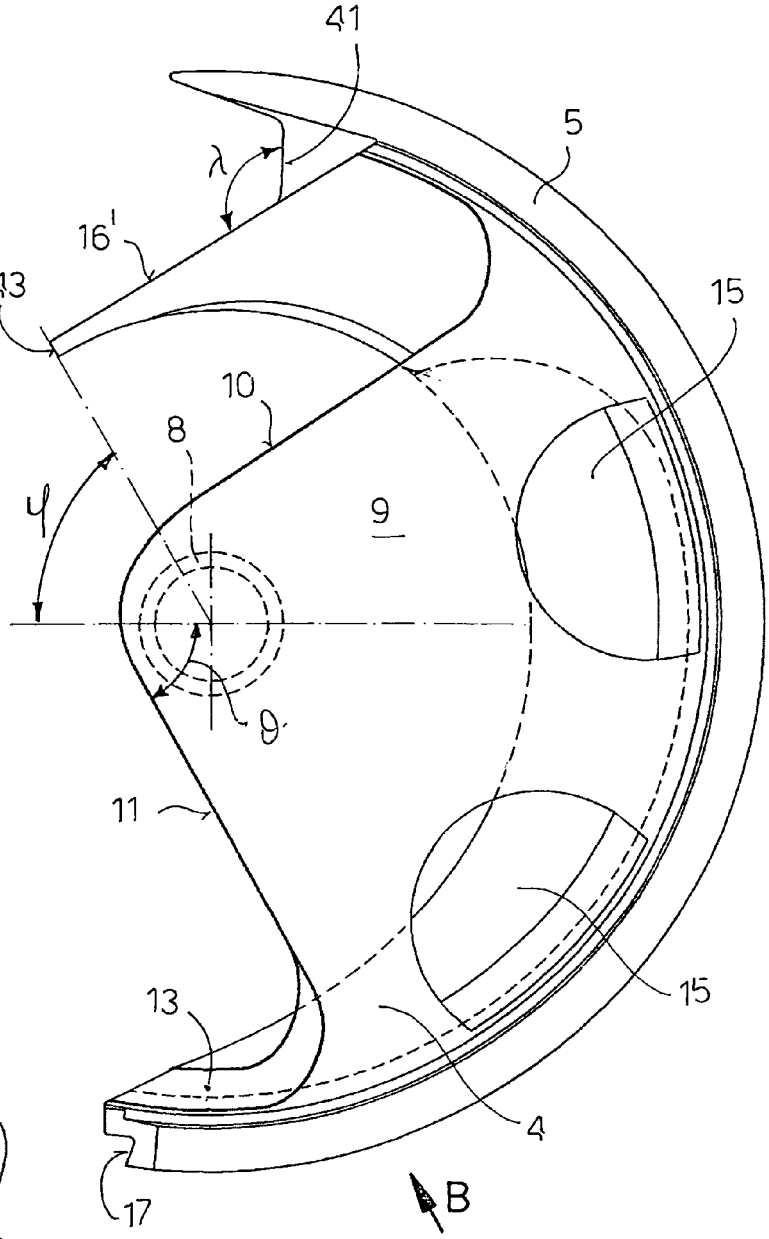
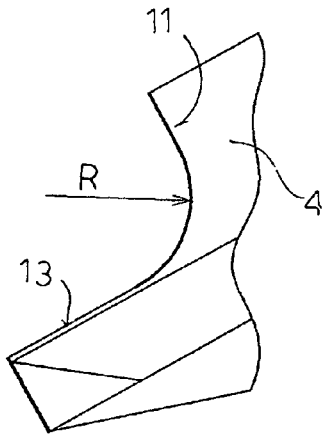
FIG. 7

CENTRAL BOBBIN SHUTTLE

FIELD OF INVENTION

The present invention pertains to a central bobbin shuttle and in particular a central bobbin shuttle used in sewing machines for domestic and industrial use.

BACKGROUND

Central bobbin shuttles are oscillating members which cooperate with a needle translating vertically in an alternating manner to form a lock-stitch seam.

Shuttle units of the prior art are composed of a shuttle body, also referred to herein merely as a shuttle, with a hollow semicylindrical shape, a bobbin case hinged inside the shuttle body and containing a thread bobbin and a shuttle driver guided in alternating rotation to force the shuttle body to oscillate in an alternating manner around its own axis. The shuttle body is in fact constrained to a special circular guide called a shuttle holder which allows only rotary movement thereof.

The shuttle body is provided at the top with a protruding point which grips the loop formed by the needle thread when the latter begins its upward stroke. The shuttle body, in its movement of clockwise rotation, after having gripped the loop with the special point, brings the latter to position itself in a special recess called a loop divider and, continuing in its rotation, widens the loop until it wraps around the bobbin.

At this point, under the action of the shuttle driver, the shuttle body, which has completed more than 180°, reverses its direction of rotation to return to the initial position and, at the same time, the loop, sliding on the shuttle body and the bobbin case, is closed by a special member called a take-up lever, tying to itself the bobbin thread to form the so-called lockstitch.

The shuttle units currently available on the market, with the reduction of the tension on the needle and bobbin threads necessary to prevent puckering of the fabric to be sewn, have the disadvantage of forming thread eyes in the seam and presenting uneven sewing. Vice versa, excessive tensions on the threads can lead to breaking of the thread or puckering of the fabric to be sewn.

To obtain good sewing performances it is essential, therefore, for the shuttle body to have a shape able to accompany as much as possible the movement of the loop of thread that wraps around the bobbin.

Furthermore, shuttle drivers of the new generation are made of plastic and are therefore far cheaper than shuttle drivers made of metal, but nonetheless these shuttle drivers, because of their shape, imposed by the fragility of the material and by the typical problems of plastic moulding, are larger in size and, once the shuttle driver is mounted, significantly reduce the clearance for the thread loop.

Reduction of the clearance can lead to jamming of the thread loop resulting in greater tension on the thread and a consequent unevenness of the seam.

SUMMARY

The object of the present invention is to solve the problems of the prior art by providing a shuttle unit that allows the possibility of the formation thread eyes to be reduced to a minimum without requiring excessive tensions during sewing.

Another object of the present invention is to provide a shuttle unit that offers a high degree of evenness of sewing and at the same time can use either a plastic or a metal shuttle drive, nevertheless offering a large clearance for the thread loop.

Another object of the present invention is to provide a shuttle unit that is easy to make and cheap to produce.

These and other objects are achieved by the present invention which describes a shuttle unit as claimed in appended independent claim 1.

Advantageous embodiments of the invention are apparent from the dependent claims.

The shuttle unit according to the invention essentially comprises a discoid shuttle body provided with two conical portions, one at the front and one at the rear, disposed specularly with respect to the median plane of said shuttle body passing through the shuttle race, and a shuttle driver guided in alternating rotation to cause said shuttle body to oscillate. The conical portions define a cavity to contain the bobbin case hinged with the thread bobbin to a pin of the rear conical portion. The shuttle is characterised in that the conical front portion forms a base angle with the median plane in the range of 43° and 49°, preferably between 43° and 45°. The particular slope of the conical portion facilitates sliding of the loop thread on the shuttle body appreciably reducing the thread tensions responsible for unevenness in the sewing or for the formation of thread eyes.

According to an advantageous feature of the present invention, the conical front portion is cut at the front with a cam profile formed by a succession of points placed at different heights with respect to the plane of the annular race.

The cam profile is preferably divided into three portions: the first portion formed by a succession of points disposed according to increasing heights with increments every 15° of between 0.5 mm and 1.25 mm; the second portion, formed by a succession of points disposed at constant or increasing heights with increments every 15° of a maximum of 0.25 mm; and the third portion composed of a succession of points disposed according to decreasing heights with decreases every 15° comprise in the range between 0.05 mm and 0.5 mm.

The particular shape of the cam profile composed of a succession of points disposed at variable heights with respect to the plane of the race contributes to make sliding of the thread on the shuttle body even smoother, avoiding jamming of said thread on the shuttle body.

According to another advantageous feature of the present invention, the shuttle body comprises a bottom protruding from the conical rear portion and disposed parallel to the plane of the shuttle race to support the hinge pin of the bobbin and the bobbin case.

According to another preferential aspect of the present invention, the bottom comprises two inclined profiles, a top one and a bottom one, converging in the vicinity of the pin. The bottom profile is disposed along a straight line forming an angle Θ with the horizontal. The angle Θ é is preferably comprised between 60° and 64°.

According to another advantageous aspect of the present invention, the bottom profile is joined by a radius between 3.5 mm and 4.5 mm to the end of the bottom conical portion which has a straight portion parallel to the rear plane of the annular race and spaced from said plane by a distance of not more than 0.5 mm.

The particular shape of the bottom profile allows the space between the shuttle body and the shuttle driver to be increased, favouring disengagement of the thread loop as the shuttle point returns upwards, in the anti-clockwise rotation of the shuttle body, preventing jamming of the thread in the shuttle driver also and above all with shuttle drivers of the latest generation made of plastic.

BRIEF DESCRIPTION OF THE DRAWINGS

Further characteristics and advantages of the present invention will become clearer after the present description made by way of non-limiting example with reference to the appended drawings, in which:

FIG. 4 is a partial side view of a detail of the shuttle body according to the present invention, as indicated by the arrow M of FIG. 2;

FIG. 5 is a sectional view of the shuttle body of FIG. 2;

FIG. 6 is a plan view from the rear of the shuttle body according to the present invention; and FIG. 7 is a partial side view of a detail of the shuttle body according to the present invention, as indicated by the arrow B of FIG. 6.

DETAIL DESCRIPTION

Figure 1:
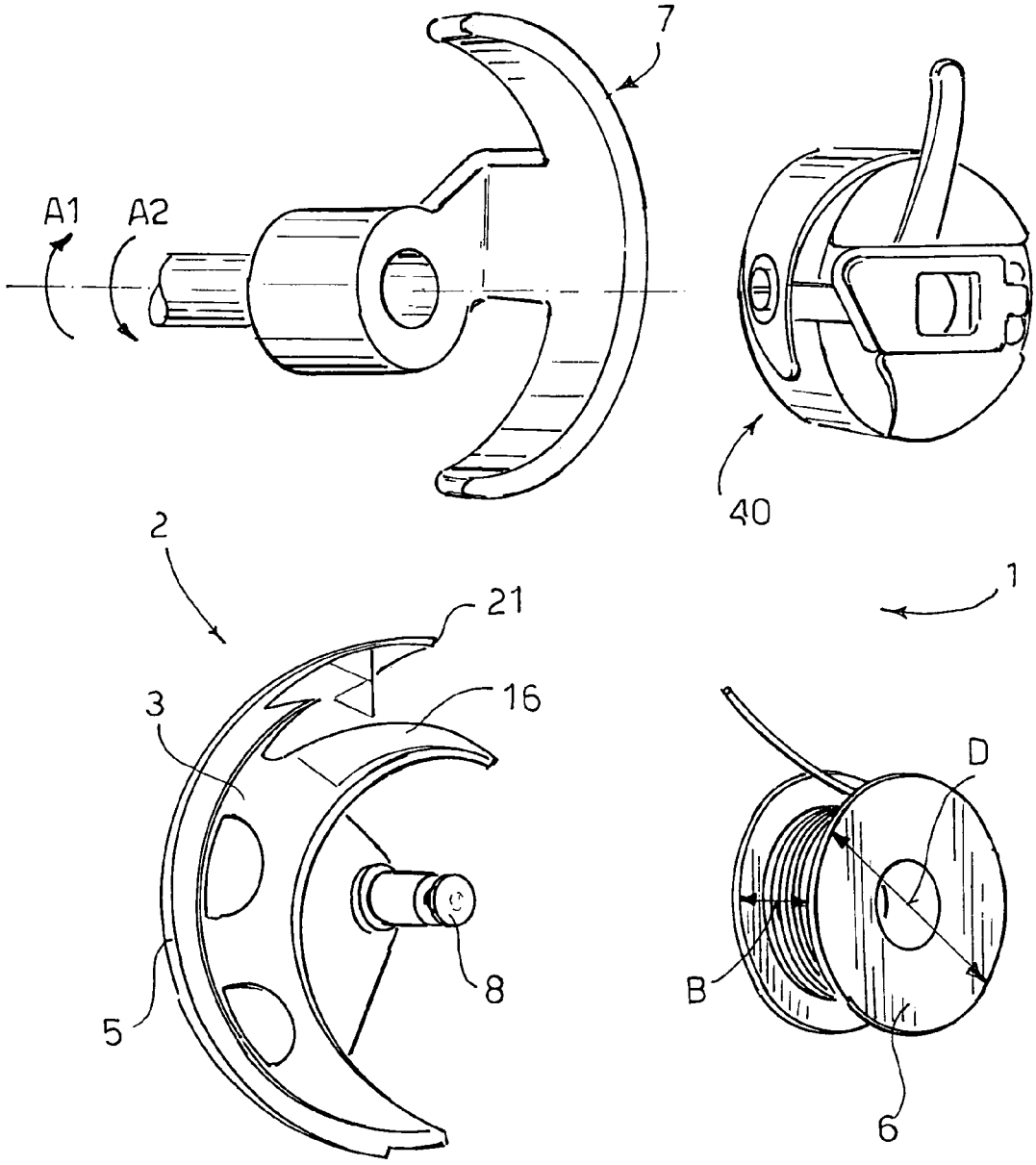
FIG. 1 is an exploded view of a shuttle unit according to the present invention.
Figure 3:
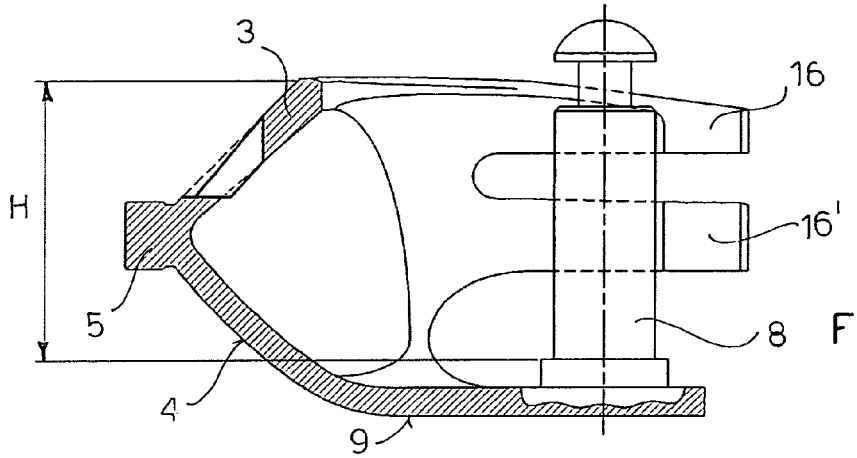
FIG. 3 is a side sectional view of the shuttle body taken along the plane A—A of FIG. 2.
Figure 2:
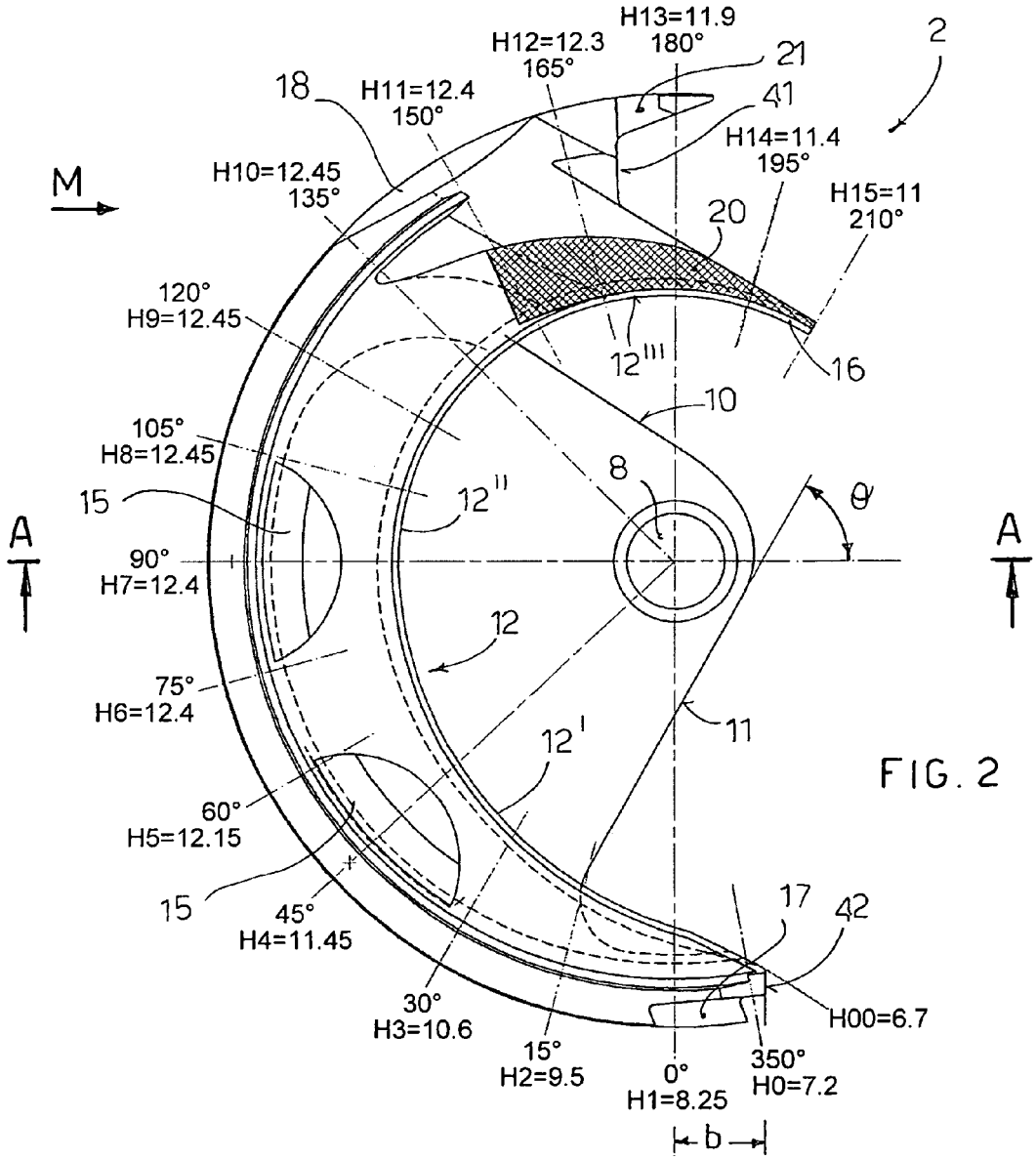
FIG. 2 is a front plan view of an embodiment of a shuttle body according to the present invention.

With reference to the figures and in particular for the moment to FIGS. 1, 2 and 3, a shuttle unit 1 according to the present invention comprising a shuttle body 2 and a shuttle driver 7 is illustrated.

The discoid shaped shuttle body 2 is provided with two conical portions 3, 4, one front 3 and one rear 4, disposed specularly with respect to the median plane of the shuttle body 2 passing through the annular race 5 of the shuttle body. The circular portions define a cavity for containing the bobbin 6 of thread and for the bobbin case 40 containing the bobbin 6.

The shuttle driver 7 is guided in rotation to make the shuttle body 3 oscillate alternately by acting on the loop divider 41 and on the end portion 42. The end portion 42 is normally called the shuttle driver plane.

The bobbin 6 and the bobbin case 40 are hinged around the pin 8 of the rear conical portion 4. With the device assembled the pin 8 is coaxial to the axis of rotation of the shuttle driver 7.

The shuttle body 2 further comprises, again in a known manner, a point 21 disposed at the top end of the annular race 5, above the loop divider 41, and able to engage the loop formed by the needle thread during its upward movement.

The conical front portion 3, as better illustrated in FIG. 5, forms a base angle $\alpha$ with the median plane of the shuttle, that is to say the plane passing through the annular race 5, comprised between 43° and 49°.

The base angle $\alpha$ is preferably comprised between 43° and 45°.

In the present description all the angles in the plan view are expressed with respect to the axes obtained by placing the shuttle with the shuttle driver plane 42 at a distance b from the vertical (ordinate axis) of between 3.8 mm and 4.2 mm.

The conical front portion 3 is cut at the front with a cam profile 12 formed by a succession of points which have variable heights with respect to the plane of the annular race 5.

In other words, the cam profile 12 does not lie on a plane parallel to or inclined constantly with respect to the plane of the annular race 5, but lies on a plurality of planes disposed with a variable slope with respect to said plane.

The cam profile 12, divided into three portions, is therefore disposed like a helix with a variable radius and pitch and having an axis coinciding with the axis of the shuttle. The first portion 12' which has an angular width of about 80° is formed by a succession of points placed at increasing heights with respect to the plane of the annular race 5 with increments in height every 15° of between 0.5 mm and 1.25 mm.

The second portion 12", which has an angular width of about 75°, is provided with an almost constant course and is formed by a succession of points disposed at constant or increasing heights with respect to the annular race. In particular, there are increments in height every 15° of a maximum of 0.25 mm.

The slope of the second portion of the cam profile therefore decreases with respect to the slope of the first portion.

The third portion 12''', which has an angular width of about 75°, is provided with a decreasing course and is formed by a succession of points disposed at decreasing heights with respect to the plane of the annular race, in other words with decreases in heights every 15° of between 0.05 mm and 0.5 mm.

In particular, in FIG. 2 a preferential embodiment of the shuttle body according to the present invention is shown in which, to illustrate better the course of the cam profile 12, the heights of some points, offset by 15°, forming said profile are shown directly on the figure. The heights H in question are taken, as can be seen from FIG. 3, with respect to the base plane of the pin 8.

The particular shape of the conical portion and the cam profile thereof ensure perfect sliding of the thread loop on the shuttle body 2 during the phase of widening of the loop, that is to say during clockwise rotation of the shuttle.

Furthermore, in order to ensure easier sliding of the thread loop on the shuttle body 2 and, in particular, disengagement of the loop from the upper end 16 of the front conical portion 3 when the point of the shuttle body is in the position of maximum descent, that is to say with the shuttle body rotated by about 180° with respect to the starting position, a bevel 20 is provided on said conical portion 3, as shown in FIGS. 2 and 4.

The bevel 20 provided at the top end 16 of the conical front portion 3 is disposed to form an angle $\beta$ with respect to the axis of rotation of the shuttle comprised between 44° and 52°. This bevel causes the space occupied by the conical portion of the shuttle body to decrease in this area, facilitating disengagement of the thread with respect to said portion.

The rear conical portion 4 of the shuttle body 2, on the other hand, has a flat bottom 9 which represents the continuation thereof and is disposed parallel to the plane of the annular race 5.

Said shaped bottom 9 delimits the cavity of the shuttle body 2 for containing the bobbin 6 and the bobbin case 40 at the rear and supports the pin 8 at the centre.

The bottom 9 has, as can be seen better in FIG. 6, two inclined profiles 10, 11, one 10 at the top and one 11 at the bottom, converging in the central portion of the shuttle at the pin 8.

In particular the top profile 10, as shown in FIG. 6, is joined to the top end of the rear conical portion which ends on the race 5.

The bottom profile 11 is joined, again as shown in FIGS. 6 and 7, to the bottom end of the rear conical portion 4 which has a straight portion 13 substantially parallel to the plane of the race 5.

In particular the bottom profile 11, as can be seen in FIG. 7, is joined to the straight portion 13 with a connecting radius of comprised between 3.5 mm and 4.5 mm. The straight portion 13 is placed at a distance of 0.5 mm or less with respect to the plane of the bottom race 5.

The bottom profile 11 is furthermore disposed, as shown in FIGS. 2 and 6, along a straight line forming an angle Θ with the horizontal comprised between 58° and 66°.

The particular shape of the profile 11 together with the bottom end of the conical portion 4 and of the protrusion 13 creates a loop which increases the space between the shuttle body and the shuttle driver, appreciably reducing the possibility that the thread loop disengaged by the point 21 and by the top end portion of the shuttle body 2 might jam between the shuttle body 2 and the shuttle driver 7.

At the top, beneath the point 21, the shuttle body has a slit 14 which cuts the conical front portion 3, at its top end, to form two tabs 16, 16'.

In particular, as can be seen in FIG. 2, the tab 16 has the bevel 20. The two tabs 16, 16' protrude forward with respect to the axis of symmetry of the pin 8 and stop on a plane passing through the axis of symmetry of the pin 8 and forming an angle ϕ with the horizontal comprised between 58 and 62 degrees. The tabs have ends with a variable thickness ranging between 0.5 and 0.7 mm and are disposed along a straight line forming an angle λ with the loop divider 41 comprised between 121° and 125°.

The particular conformation of the tabs 16, 16' and the tapered shape thereof, superior to that of shuttles of the prior art, facilitates disengagement of the thread loop, when the point of the shuttle body is in its bottom position or position of maximum clockwise rotation. In this manner in fact, the thread loop is carried out of the possible area of interference with the bobbin case 40.

Each conical portion 3, 4 further comprises two lightening slots 15 disposed in proximity to the race 5 and able to reduce the mass and consequently the inertia of the shuttle body 2.

At the bottom end of the race 5, there is further present a thread cutter 17, formed by a sharpened portion of said race, able to cut the thread if it jams between the shuttle body 3 and the shuttle holder (not shown) of the sewing machine.

Almost at the opposite end, that is to say the top end having the point 21, the race has a flat needle guard portion 16.

The needle guard portion 16 in fact serves to bring the needle into the correct position with respect to the slot 14 should the tension of the fabric have moved the needle from the correct alignment.

Many modifications and variants, within the reach of an average person skilled in the art, can be made to the present invention without departing from the scope of protection thereof.

The invention claimed is:

1. A shuttle unit of the type comprising a discoid shuttle body provided with two conical portions comprising a front conical portion and a rear conical portion, the conical portions disposed specularly with respect to a median plane of said shuttle body passing through a race of the shuttle, and a shuttle driver guided in alternating rotation to make said shuttle body oscillate, said conical portions defining a cavity for containing a bobbin case which is rotatably mounted, together with a thread bobbin, on a pin of the rear conical portion of said shuttle body, characterized in that the front conical portion forms a base angle α with the median plane of the shuttle body comprised between 43° and 49°.

2. A shuttle unit according to claim 1, characterized in that said base angle α is between 43° and 45°.

3. A shuttle unit according to claim 1, characterized in that said front conical portion is cut at a top with a cam profile formed by a succession of points disposed at variable height with respect to the plane of said race.

4. A shuttle unit according to claim 3, characterized in that said cam profile is divided into three portions, a first portion formed by a succession of points disposed along increasing heights with increments every 15° of between 0.5 and 1.25 mm, a second portion formed by a succession of points disposed according to constant or increasing heights with increments every 15° of not more than 0.25 mm, and a third portion formed by a succession of points disposed along decreasing heights with decrements every 30° comprised between 0.05 and 0.5 mm.

5. A shuttle unit according to claim 1, characterized in that said front conical portion has a bevel at its top end with an angle of slope β with respect to an axis of rotation of the shuttle comprised between 44° and 52°.

6. A shuttle unit according to claim 1, characterized in that said shuttle body comprises a bottom end protruding from said rear conical portion and disposed parallel to the median plane of said race to support said pin, said bottom end comprising two sloping profiles comprising a top profile and a bottom profile, said two sloping profiles converging in proximity to said pin, and said bottom profile being disposed along a straight line forming an angle Θ with a horizontal.

7. A shuttle unit according to claim 6, characterized in that said angle Θ is comprised between 60° to 64°.

8. A shuttle unit according to claim 6, characterized in that said bottom profile is joined with the bottom end of the rear conical portion which has a straight portion parallel to the rear plane of said race and spaced from said plane by a distance of 0.5 mm or less.

9. A shuttle unit according to claim 8, characterized in that said bottom profile is joined to the straight portion with ajoining radius comprised between 3.5 mm and 4.5 mm.

10. A shuttle unit according to claim 1, characterized in that it comprises a slit which cuts said front conical portion at its top end to form two reciprocally spaced tabs defining a passage for a needle.

11. A shuttle unit according to claim 10, characterized in that said tabs stop, in a plan view, on a plane passing through the axis of symmetry of said pin and forming an angle ϕ with the horizontal, comprised between 58° and 62°.

12. A shuttle unit according to claim 10, characterized in that said tabs comprise one end with a thickness between 0.5 and 0.7 mm and have a top linear profile forming an angle λ with a loop divider comprised between 121° to 125°.

13. A shuttle unit comprising:

a discoid shuttle body provided with two conical portions comprising a front conical portion and a rear conical portion, the conical portions disposed specularly with respect to a median plane of said shuttle body passing through a race of the shuttle, said front conical portion cut at a top with a cam profile formed by a succession of points disposed at variable height with respect to the plane of said race, said cam profile divided into three portions comprising a first portion formed by a succession of points disposed along increasing heights with increments every 15 degrees of between 0.5 and 1.25 mm, a second portion formed by a succession of points disposed according to constant or increasing heights with increments every 15 degrees of not more than 0.25 mm, and a third portion formed by a succession of points disposed along decreasing heights with decrements every 30 degrees comprised between 0.05 and 0.5 mm, said conical portions defining a cavity for containing a bobbin case which is rotatably mounted, together with a thread bobbin, on a pin of the rear conical portion of said shuttle body, wherein the front conical portion forms a base angle $\alpha$ of between 43 and 49 degrees with the median plane of the shuttle body; and a shuttle driver guided in alternating rotation to make said shuttle body oscillate.

14. A shuttle unit according to claim 13, characterized in that said front conical portion has a bevel at its top end with an angle of slope $\beta$ with respect to an axis of rotation of the shuttle comprised between 44 and 52 degrees.

15. A shuttle unit according to claim 13, characterized in that said shuttle body comprises a bottom protruding from said rear conical portion and disposed parallel to the plane of said race to support said pin, said bottom comprising two sloping profiles, one top and one bottom converging in proximity to said pin, and said bottom profile being disposed along a straight line forming an angle $\Theta$ with the horizontal.

16. A shuttle unit according to claim 15, characterized in that said angle $\Theta$ is comprised between 60 to 64 degrees.

17. A shuttle unit according to claim 15, characterized in that said bottom profile is joined with the bottom end of the rear conical portion which has a straight portion parallel to the rear plane of said race and spaced from said plane by a distance of 0.5 mm or less.

18. A shuttle unit according to claim 17, characterized in that said bottom profile is joined to the straight portion with a joining radius comprised between 3.5 mm and 4.5 mm.

19. A shuttle unit according to claim 13, characterized in that it comprises a slit which cuts said front conical portion at its top end to form two reciprocally spaced tabs defining a passage for a needle.

20. A shuttle unit according to claim 19, characterized in that said tabs stop, in a plan view, on a plane passing through the axis of symmetry of said pin and forming an angle $\phi$ with the horizontal, comprised between 58 and 62 degrees.

21. A shuttle unit according to claim 19, characterized in that said tabs comprise one end with a thickness between 0.5 and 0.7 mm and have a top linear profile forming an angle $\lambda$ with a loop divider comprised between 121 to 125 degrees.

22. A shuttle unit comprising:

a discoid shuttle body provided with two conical portions comprising a front conical portion and a rear conical portion, the conical portions disposed specularly with respect to a median plane of said shuttle body passing through a race of the shuttle, said conical portions defining a cavity for containing a bobbin case which is rotatably mounted, together with a thread bobbin, on a pin of the rear conical portion of said shuttle body, wherein the front conical portion forms a base angle $\alpha$ of between 43 and 49 degrees with the median plane of the shuttle body, wherein said shuttle body comprises a bottom end protruding from said rear conical portion and disposed parallel to the median plane of said race to support said pin, said bottom end comprising two sloping profiles comprising a top profile and a bottom profile, said two sloping profiles converging in proximity to said pin, and said bottom profile being disposed along a straight line forming an angle $\Theta$ with a horizontal, wherein said bottom profile is joined with the bottom end of the rear conical portion which has a straight portion parallel to the rear plane of said race and spaced from said plane by a distance of 0.5 mm or less; and a shuttle driver guided in alternating rotation to make said shuttle body oscillate.

23. A shuttle unit according to claim 22, characterized in that said bottom profile is joined to the straight portion with a joining radius comprised between 3.5 mm and 4.5 mm.

* * * * *